United States Patent [19]

Belvedere

[11] Patent Number: 4,584,957

[45] Date of Patent: Apr. 29, 1986

[54] MULTI-HULL SAILING VESSEL WITH VARIABLE LIFT

[76] Inventor: Mark S. Belvedere, 18126 Strathern St., Reseda, Calif. 91335

[21] Appl. No.: 570,983

[22] Filed: Jan. 16, 1984

[51] Int. Cl.[4] ..... B63H 9/04

[52] U.S. Cl. ..... 114/39; 114/61; 114/91; 114/162; 114/163; 114/165

[58] Field of Search ..... 114/39, 61, 91, 162, 114/163, 165, 138, 141, 272, 273, 128

[56] References Cited

U.S. PATENT DOCUMENTS

| | | | |
|---|---|---|---|
| 208,750 | 10/1878 | McColgan | 114/128 |
| 1,916,459 | 7/1933 | Blackman | 114/91 |
| 2,756,711 | 7/1956 | Simpson | 114/39 |
| 2,991,749 | 7/1961 | Patterson | 114/162 X |
| 3,173,395 | 3/1965 | Laurent | 114/39 |
| 3,336,890 | 8/1967 | Laurent | 114/39 |
| 3,547,065 | 12/1970 | Chauveau | 114/138 |
| 3,646,902 | 3/1972 | Smith | 114/66.5 H |
| 3,870,004 | 3/1975 | Bailey | 114/39 |
| 3,960,102 | 6/1976 | Davy | 114/61 X |
| 4,005,669 | 2/1977 | Klemm | 114/91 |
| 4,046,093 | 9/1977 | Prindle et al. | 114/165 |
| 4,061,099 | 12/1977 | Cook | 114/39 |
| 4,108,100 | 8/1978 | Jamieson | 114/102 |
| 4,280,428 | 7/1981 | Werner, Jr. | 114/39 |
| 4,406,239 | 9/1983 | Enzmann | 114/165 X |
| 4,537,145 | 8/1985 | White | 114/39 |

FOREIGN PATENT DOCUMENTS

| | | | |
|---|---|---|---|
| 350860 | 6/1931 | United Kingdom | 114/272 |

OTHER PUBLICATIONS

Wind Surf, pp. 41, 74, 75 and 77, Jun., 1984.

Norwood, Joseph Jr., *Highspeed Sailing,* Granada Publishing, New York, 1979, pp. 107–117.

AYRS Publication, The Single-Handed Trans Atlantic Races, No. 71, 1/70, pp. 80–86.

*Primary Examiner*—Sherman D. Basinger

*Attorney, Agent, or Firm*—Sheldon & Mak

[57] ABSTRACT

A double-ended two hull sailing vessel has a main hull and an auxiliary hull, where the distance between the auxiliary hull and the main hull can be varied for controlling heel. The mast is supported on a curved track for varying the angle of the mast relative to the water surface to control the upward lifting force of wind on the vessel to assist in maintaining both hulls level with minimum wetted surface area. A rudder/airfoil assembly is provided at each end of the main hull for providing a lifting force to the forward end of the vessel and for steering the vessel. A control system is provided so that only one of the rudders is in the water and for controlling the orientation of the rudder that is in the water.

26 Claims, 7 Drawing Figures

MULTI-HULL SAILING VESSEL WITH VARIABLE LIFT

BACKGROUND

The present invention relates to multi-hull sailing vessels.

A variety of multi-hull sailing vessels are known such as trimarans, catamarans, and proas. Such vessels are described in U.S. Pat. Nos. 2,756,711; 3,173,395; 3,336,809; 3,646,902; 3,870,004; 4,108,100; and 4,280,428.

It is known that higher speeds can be obtained if both of the hulls of a multi-hull vessel are level with minimum wetted surface. However, difficulty has been experienced in designing a stable vessel that can maintain both of the hulls level in winds of varying speed due to heeling. The present invention is directed to a stable, multi-hull sailing vessel that has the capability of achieving high speeds even in high winds by having a control system that (1) helps maintain the hulls level, and (2) reduces the wetted surface of the hulls.

SUMMARY

A multi-hull sailing vessel according to the present invention has a main hull, an auxiliary hull, and a pair of connecting arms connecting the auxiliary hull to the main hull. A mast for supporting a sail is provided with the base of the mast slideably mounted on a curved mast mounting track. The mast mounting track is generally transverse to the longitudinal axis of the main hull. Rigging is provided for moving the mast along the mast mounting track. This varies the angle of the mast relative to the water surface to control the upward lifting force of wind on the vessel. By controlling the upward lifting force, the total wetted surface of the vessel can be minimized while the vessel is maintained on an even keel with the auxiliary hull of the vessel, even in strong winds, in the water. Low wetted surface area results in high speeds.

Preferably there is a linear track on each connecting arm where the auxiliary hull is moveably mounted on the tracks. This allows the distance between the auxiliary hull and the main hull to be varied to prevent the vessel from capsizing in strong winds and to help maintain the auxiliary hull in the water and to trim the vessel for low wetted surface area.

Preferably the curved mast mounting track is sufficiently curved that the mast can be supported thereon at an angle less than 15 degrees off the horizon for maximum lifting force, to an angle greater than 5 and preferably about 15 degrees to leeward.

Preferably the vessel is capable of sailing in either direction. For this purpose, the main hull is provided with a pair of rudder/airfoil assemblies, one assembly located near each end of the main hull. Each assembly comprises a lower rudder portion and an upper airfoil portion. The assemblies are vertically slideably mounted through the main hull, and include means biasing each assembly upwardly and control means for pulling the assemblies downwardly. The control means is designed so that it is capable of pulling only one of the assemblies downwardly at a time, depending upon which direction the vessel is being sailed.

For optimum tuning of the sails of the vessel as it sails in either direction, preferably the mast is supported by a strut that is pivotally mounted at both ends, at one end to the mast and at the other end to a cross arm supported by the connecting arms. Also, preferably one end of the curved mast mounting track is pivotally mounted and the other end is mounted to slide along a curved slide oriented generally parallel to the longitudinal axis of the main hull.

DRAWINGS

These and other features, aspects, and advantages of the present invention will become better understood with reference to the following description, appended claims, and accompanying drawings where:

Figure 1:
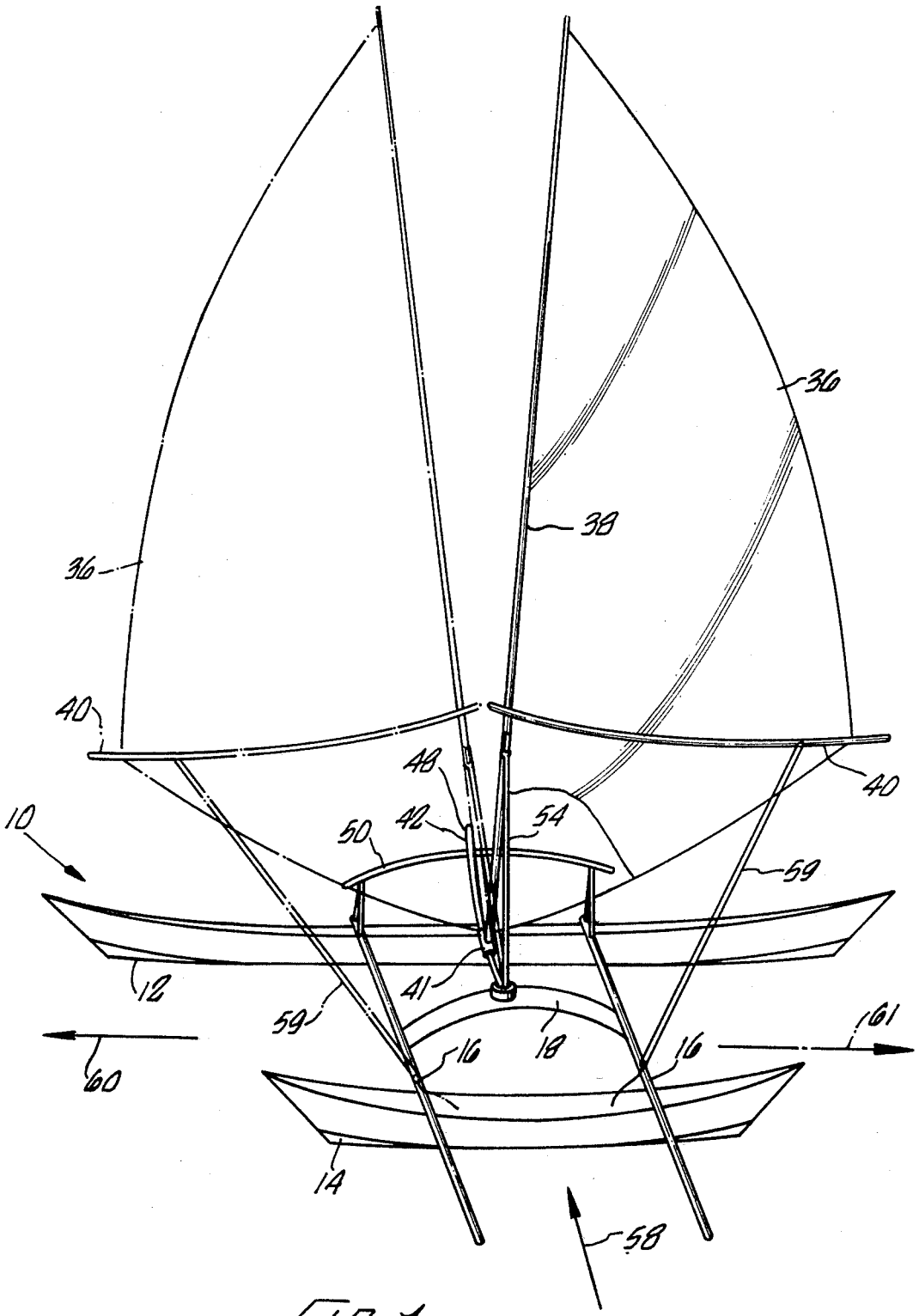
FIG. 1 is a side elevation view of a sailing vessel embodying features of the present invention.
Figure 7:
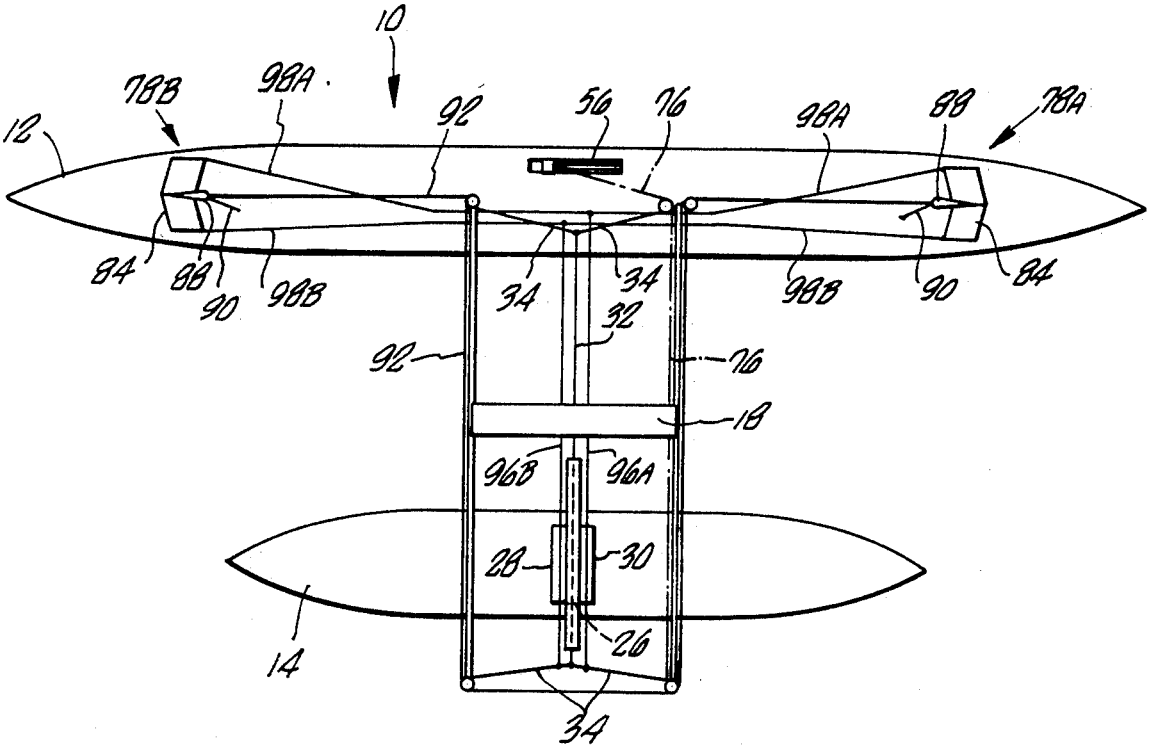
Figure 6:
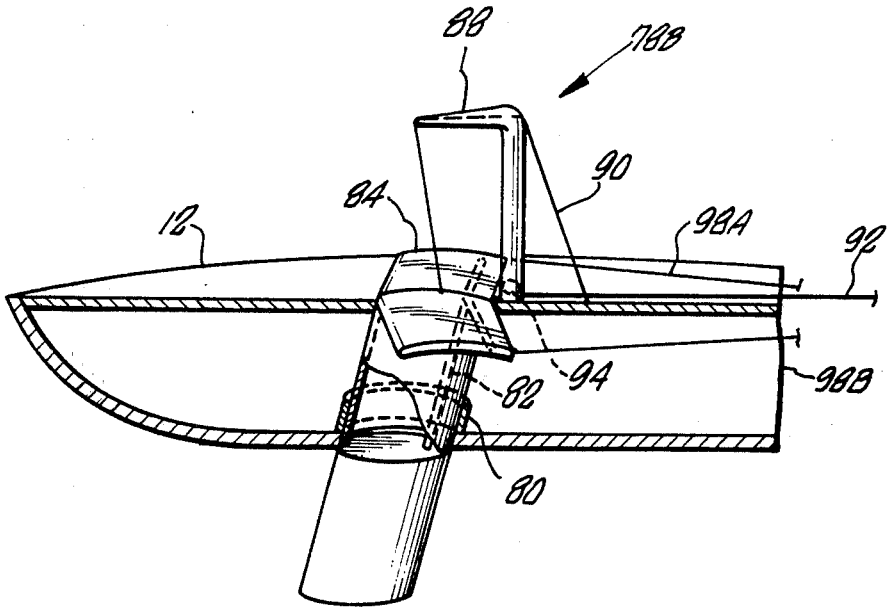

FIG. 6 schematically shows one of the airfoil/rudder assemblies of the vessel of FIG. 1; and FIG. 7 is a plan view of some of the controls of the vessel of FIG. 1.

DESCRIPTION

With reference to the figures, a multi-hull sailing vessel, and in particular a proa type vessel 10 comprises a main hull 12 and a smaller auxiliary hull 14. The two hulls are connected by a pair of generally parallel connecting arms 16 including a cross arm 18 between the connecting arms 16 for reinforcement. Both the main hull 12 and the auxiliary hull 14 are double ended so that the vessel 10 is capable of sailing in either direction.

Figure 2:
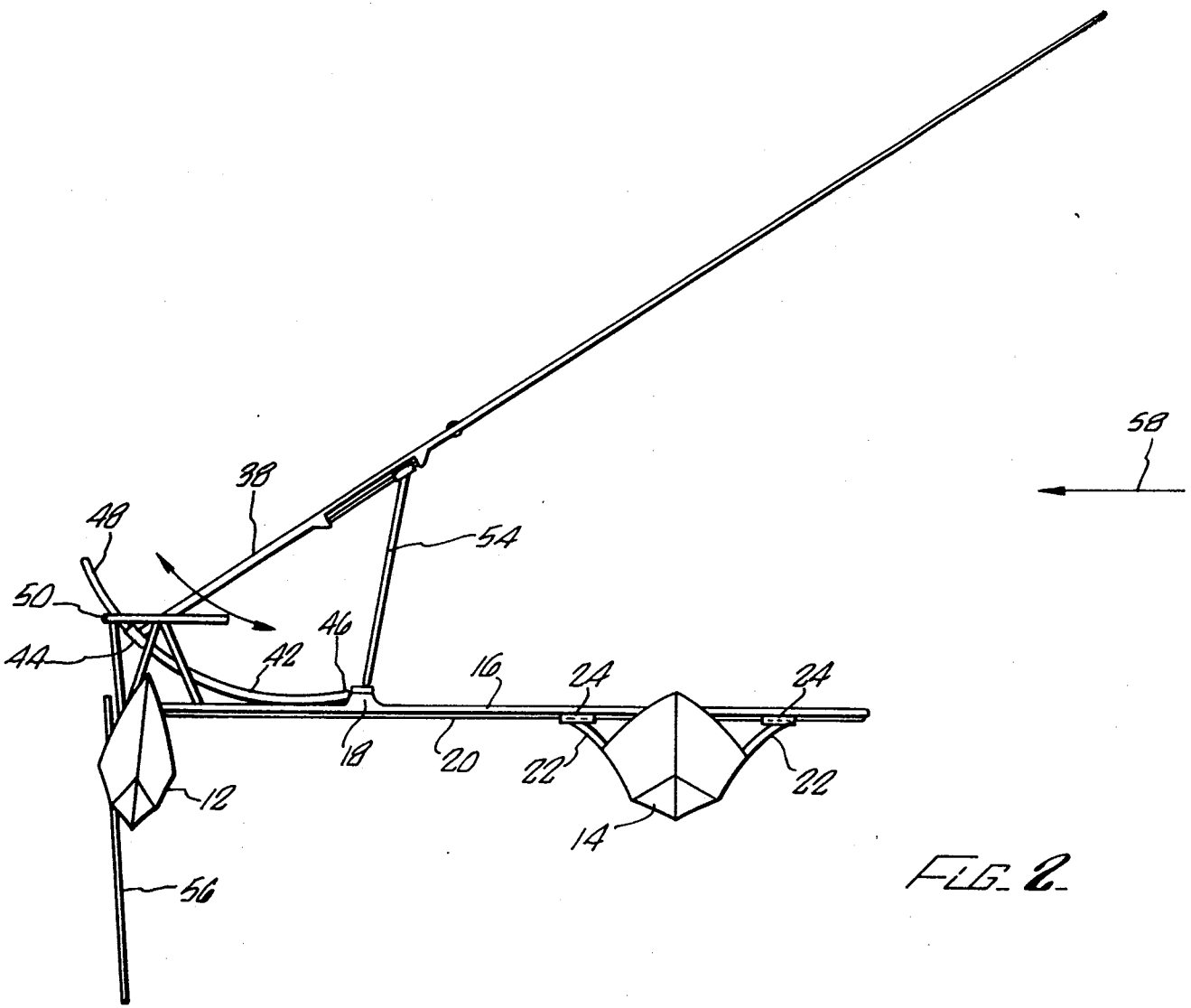
FIG. 2 is a front elevation view of the vessel of FIG. 1.

As best shown in FIG. 2, a linear track 20 is mounted on the underside of each connecting arm 16. The auxiliary hull 14 is connected to each track 20 by two pair of struts 22, one pair for each track 20. Slides 24 are provided at the end of each of the struts 22 to allow the auxiliary hull to move along the tracks 20 for varying the distance between the main hull 12 and the auxiliary hull 14. The smaller auxiliary hull 14 can be shifted mechanically, using a winch system, or by using a pneumatic or hydraulic system. In the version shown in FIG. 5, the auxiliary hull 14 is moved by a piston 26 that is pressured to and fro in a cylinder 28 by compressed air from an air source 30. The cylinder 28 is supported by a rod 32 that is between and generally parallel to the connecting arms 16. The rod 32 is anchored at both ends by anchoring wires 34 to the ends of the connecting arms 16.

Figure 3:
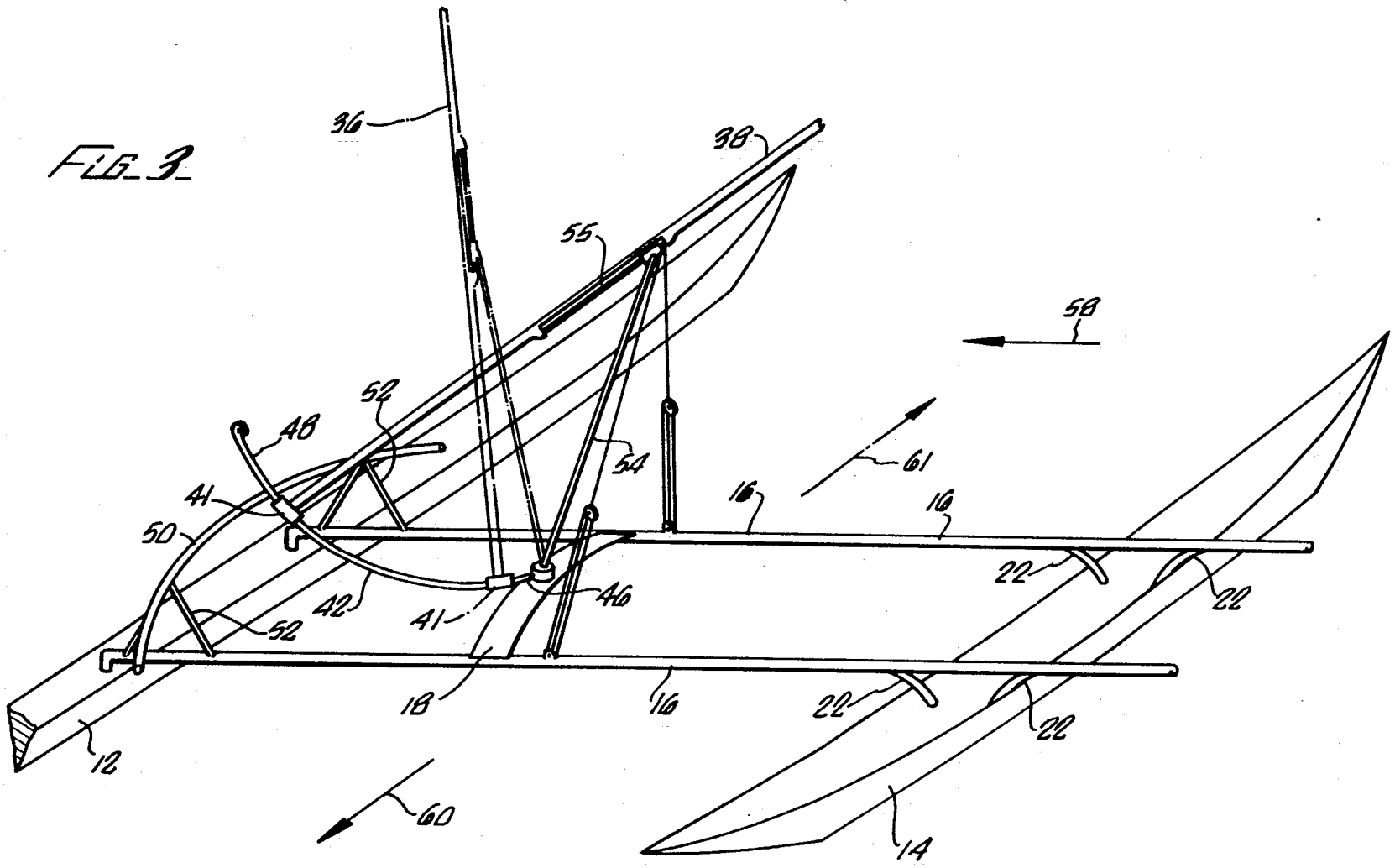
FIGS. 3–5 are perspective views of the vessel of FIG. 1, each showing different features of the vessel.
Figure 4:
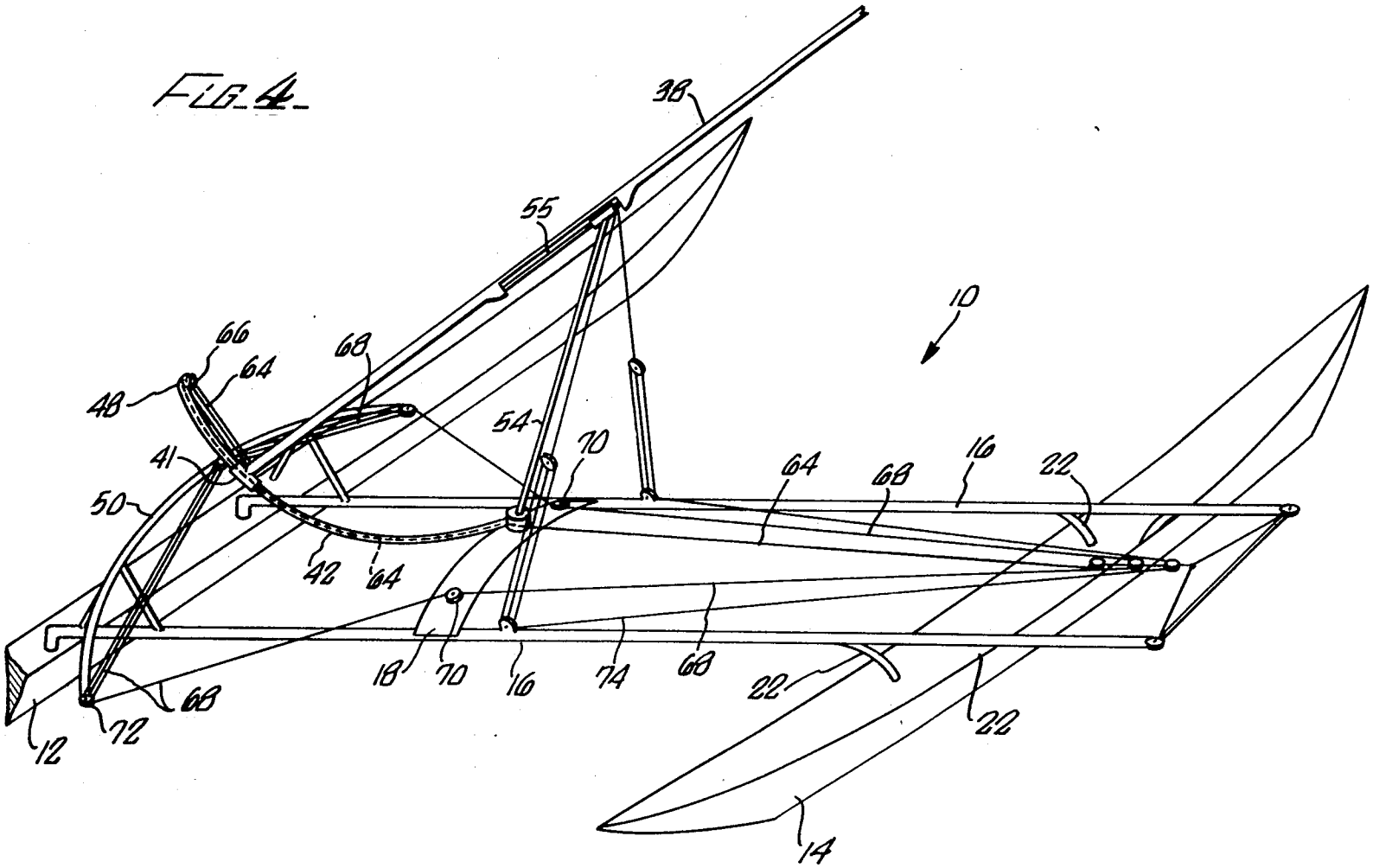

As shown in FIGS. 1, 3 and 4, a sail 36 is supported by a mast 38 and a boom 40. The foot of the mast 38 has a glide 41 thereon and is mounted to slide along a curved mast mounting track 42 that is generally transverse to the longitudinal axis of the main hull 12. The mast 38 is mounted to pivot universally on the glide 41. The mast mounting track 42 curves upwardly at both ends, with the first end 46 pivotally secured to the cross arm 18. The second end 48 that is closer to the main hull 12 slides along a curved slide 50. Both ends of the curved slide 50 curve laterally toward the auxiliary hull 14 and are supported by a pair of legs 52 mounted on one of the connecting arms 16. Not only can the mast 28 move along the mast mounting track 42, but in addition the entire mast mounting track 42 can move along the curved slide 50.

As shown in FIG. 2, the mast 38 is supported by a strut 54 that is universally pivotally supported at its base on the cross arm 18. The top end of the strut 54 is mounted to pivot and slide on a slide rod 55 built into the mast 38.

Figure 5:
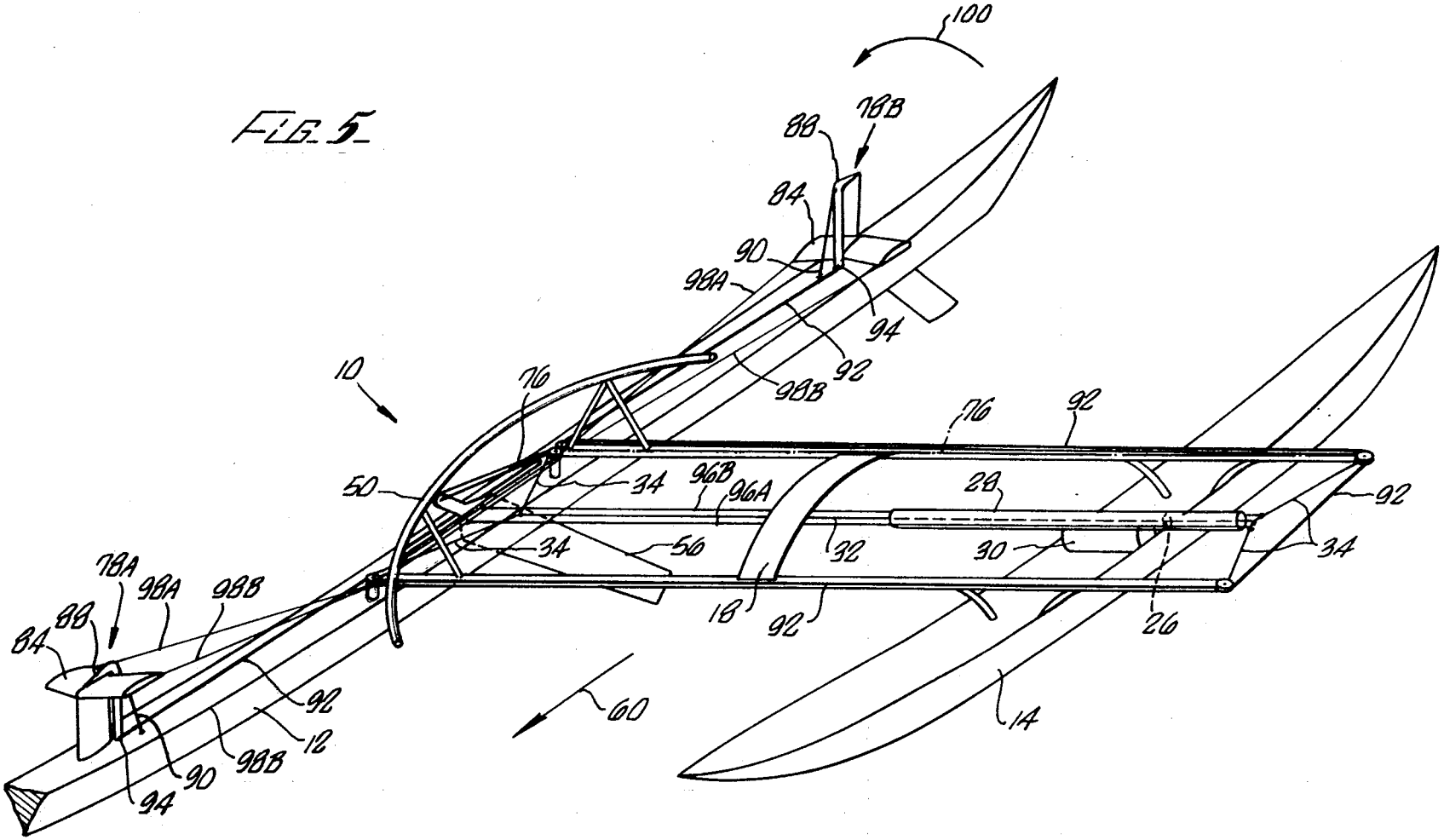

As shown in FIGS. 2 and 5, the main hull 12 has a retractable, pivotable centerboard 56 that is tilted inwardly toward the auxiliary hull 14 to assist in lifting the main hull 12 upwardly. Preferably the tilt angle is about 3 to 6 degrees from the vertical. The centerboard 56 is retractable so that the vessel 10 can be sailed in shallow waters and onto a beach.

The sailor and any passengers sail in the auxiliary hull 14 and can control the vessel from that location by means of lines described below.

The sail 36 is held in the desired orientation by sheets 59 attached at one end to the boom 40 and at the other end on one of the connecting arms 16 near the auxiliary hull 14 where the sheets 59 can be operated by the sailor.

With reference to FIGS. 1 and 3, arrow 58 shows the direction of the wind with the vessel sailing in the direction shown by arrow 60, i.e. to the left in FIG. 1. A change in direction of the vessel 10 is easily effected by changing the orientation of the sail 36. By having the sail 36 in the location shown in phantom in FIG. 1, the vessel 10 moves in the direction shown by arrow 61 in FIG. 1, i.e. to the right. By letting loose of the sheet 59 in use, the sail 36 luffs to leeward, the boat loses its headway, and comes to a total stop. This allows the sailor to sheet in the other sheet 59 and head in the reverse direction.

As shown in FIG. 2, a substantial lifting force can be obtained on the vessel by moving the mast 38 toward the second end 48 of the mast mounting track 42. The lifting force is created when the mast 38 is leaned toward the wind 58. The lateral force created in this orientation is held by the center board 56. As best seen in FIG. 2, the track 42 is sufficiently curved that by pulling the mast 38 to the second end 48 of the track, the mast can be supported at an angle less than 15 degrees and generally about 10 degrees off the horizon for maximum lifting force. Alternatively, by pulling the mast 38 toward the first end 46 of the curved mounting track, substantially no lifting force is created, and in fact the mast 38 is tilted toward leeward as shown by phantom line 62 in FIG. 3. The mast can be at an angle greater than 5 degrees off the leeward, (i.e. greater than 95 degrees relative to the horizon or water surface), and preferably about 15 degrees off the leeward. This is an effective orientation for variable light winds.

For optimum speed in the water, it is important that the auxiliary hull and main hull be level with minimum wetted surface area. There are three ways to achieve this. First, the position of the auxiliary hull 14 can be shifted along the tracks 20. By controlling the location of the auxiliary hull or outrigger 14 in the correct position for the velocity of the wind, an even lifting force on both hulls is created. This makes the vessel 10 lose wetted surface for ultimate speed without heeling. Second, the sail is tilted with more of angle into or away from the horizon to increase or decrease lifting force. Third, the heading of the vessel relative to the wind is changed.

The mast mounting track 42 is moved along the curved slide 50 as the direction the vessel 10 is sailing changed. Generally the mast mounting track 42 is kept in a forward direction for maintaining a lifting force on the bow of the vessel which is good for reaching into the wind and to prevent pearling when jumping waves. To sail in a beam reach position, the base of the mast and the mast mounting track 42 are in a midship position on the curved slide 50 as shown in FIG. 4. To sail in a down wind position, the base of the mast and the mast mounting track are to forward.

As noted above, control of the vessel is effected with lines controlled from the auxiliary hull 14. With reference to FIG. 4, movement of the mast along the curved mast mounting track 42 is controlled by a mast line 64 which passes underneath the curved mast mounting track 42 and over a pulley 66 at the second end 48 of the mast mounting track 42 from which it is connected to the base of the mast 38. By pulling on line 64, the mast 38 is pulled toward the second end 48 of the track 42. Because of the force of the wind, merely by releasing the mast line 64, the mast 38 moves to a vertical position. Because the strut 54 is pivotally mounted in universal joints at both ends and has the slide 55, the strut 54 does not affect the ability of the mast to move along the mast mounting track 42.

The location of the mast mounting track 42 along the curved slide 50 is controlled by a single continuous line 68. This line 68 extends from the auxiliary hull 14 across a pair of pulleys 70 on the cross arm 18, through a pair of pulleys 72 at the ends of the curved slide 50, and to the mast mounting track 42 where the track 42 is mounted on the curved slide 50.

A continuous strut control line 74 is used for moving the strut 54 forward and aft where it connects to the mast 38. This takes the forward driving force of the rigging and fine tunes it to more of a forward or aft position on the vessel. This line 74 can also be used to steer the vessel.

With reference to FIG. 5, the forward or aft tilt of the centerboard 56 is controlled by a centerboard line 76 that extends from the auxiliary hull along one of the connecting arms 16 to the top of the centerboard 56.

With reference to FIGS. 5, 6 and 7, the main hull 12 is provided with two rudder/airfoil assemblies 78, one for each end of the main hull. Which assembly is being used depends upon which direction the vessel 10 is sailing. In FIG. 5, the forward assembly 78A is in an up position for an airfoil effect while the rear assembly 78B is down to act as a rudder for steering the vessel 10.

The rudder/airfoil assemblies 78A and 78B are identical, and thus only one is described. The aft assembly 78B comprises a central collar 80 and a vertically oriented, internal steel shaft 82. The shaft 82 is rotatable within the collar 80. An airfoil 84 is mounted on the top of the shaft 82 above the collar and a rudder 86 is mounted on the bottom of the shaft 82 below the collar. A stop 88 mounted on the main hull 12 limits the upward movement of the assembly 78B. The rudder 80 cannot turn on its vertical axis because of the hull when the assembly 78B is in the up position. The assembly 78B can rotate on its vertical axis when in a down position, i.e. when the rudder is in the water, as shown in FIG. 6.

The assembly 78B is biased upwardly by an elastic strap 90 so that the rudder is out of the water. A single continuous rudder selection line 92 has an end connected to the upper portion of each rudder/airfoil assembly for pulling one or the other assembly downward against the biasing force of the elastic 90. A pulley 94 is provided in the main hull 12 proximate to each assembly 78. The rudder selection line 92 runs over the pulleys 94 for providing the downward direction of the pull.

Turning of the rudder is effected by a pair of steering lines 96A and 96B which extend from the auxiliary hull 14 to the main hull 12 along the rod 32. Each line 96A and 96B is connected to a corresponding transfer line 98A or 98B, respectively, which extend between the two airfoils 84. Because only one of the rudder/airfoil assemblies 78 is in a down position and the other one is prevented from pivoting by the sleeve 80, pulling on either line 96A or 96B results in pivoting of only one of the rudders. For example, as shown in FIG. 5, the aft rudder is down. Pulling on line 96B results in the aft rudder turning in the direction shown by arrow 100 in FIG. 5; pulling on line 96B results in the aft rudder turning in the opposite direction, while the forward rudder/airfoil assembly remains stationary.

The airfoils 84 are particularly useful for lifting the vessel out of the water when the vessel sails into a wave with the bow penetrating into the wave below the water level.

A vessel according to the present has many significant advantages, including the following: the sail and rigging can easily be fine tuned for maximum speed and stability in all points of sailing. The vessel 10 is seaworthy at high speeds because the sail can function as a horizontal wing thereby lifting both hulls out of the water. A hydroplaning effect can be achieved for high speed, and tacking is easily effected.

Although the present invention has been described in considerable detail with reference to certain preferred versions thereof, other versions are possible. For example, the forward rudder assembly can be placed partly in the water acting as a keel to improve tacking and prevent drift. Also, the invention is not limited to two hull vessels such as catamarans, but can be used with any multi-hull vessel. Therefore, the spirit and scope of the appended claims should not necessarily be limited to the description of the preferred versions contained herein.

What is claimed is:

1. A multi-hull sailing vessel comprising:
(a) a hull structure comprising:
(i) a main hull;
(ii) an auxiliary hull; and
(iii) connecting arms connecting the auxiliary hull to the main hull;
(b) a linear track on each connecting arm, the auxiliary hull being movably mounted on the tracks;
(c) means for moving the auxiliary hull along the linear tracks for changing the distance between the main hull and the auxiliary hull;
(d) a mast for supporting a sail, the mast having a base;
(e) a mast mounting track on the main hull on which the base of the mast is slideably and pivotally mounted for varying the angle of the mast relative to the water surface to control the upward lifting force of wind on the vessel;
(f) rigging for moving the mast along the mast mounting track; and
(g) a strut supporting the mast, the strut being moveably mounted to the mast and movably supported by the hull structure so the mast can slide and pivot, the base of the strut being laterally spaced apart from the main hull.

2. The sailing vessel of claim 1 in which the mast mounting track is generally transverse to the longitudinal axis of the main hull.

3. The sailing vessel of claim 1 in which the strut is pivotally mounted to the mast.

4. The sailing vessel of claim 3 in which the base of the strut is pivotally mounted to a cross arm supported by the connecting arms.

5. The sailing vessel of claim 1 in which the mast mounting track is sufficiently curved that the mast can be supported thereon at an angle less than 15 degrees off the horizon.

6. The sailing vessel of claim 5 in which the mast mounting track is sufficiently curved that the mast can be supported thereon at an angle greater than 5 degrees to leeward.

7. The sailing vessel of claim 1 in which the mast mounting track is sufficiently curved that the mast can be supported thereon at an angle greater than 5 degrees to leeward.

8. The sailing vessel of claim 1 in which one end of the mast mounting track is pivotally mounted and the other end can slide along a curved slide oriented generally parallel to the longitudinal axis of the main hull.

9. The sailing vessel of claim 1 in which the main hull is provided with a pair of rudders, one rudder located near each end of the main hull, the rudders being vertically slideably mounted through the main hull and having an up position and a down position, the vessel including means biasing each rudder to its up position and control means for pulling either one of the rudders downwardly to its down position so that only one of the rudders is in the water, each rudder being rotatable on its vertical axis when in the down position but not being rotatable on its vertical axis when in the up position.

10. The sailing vessel of claim 9 in which each rudder comprises an upper airfoil portion.

11. The vessel of claim 1 in which the moving means comprises a piston pressured to and fro in a cylinder by compressed air.

12. The vessel of claim 1 including a pivotable centerboard.

13. The vessel of claim 1 in which the base of the strut is pivotally supported by the hull structure.

14. The vessel of claim 1 in which the mast mounting track is curved.

15. A multi-hull sailing vessel comprising:
(a) a hull structure comprising:
(i) a main hull;
(ii) an auxiliary hull; and
(iii) at least one arm connecting the auxiliary hull to a main hull;
(b) a mast for supporting a sail, the mast having a base;
(d) a mast mounting track on which the base of the mast is slidably and pivotally mounted for varying the angle of the mast relative to the water surface to control the upward lifting force of wind on the vessel;
(d) rigging for moving the mast along the mast mounting track; and
(e) a strut supporting the mast, the strut being movably mounted to the mast and movably supported by the hull structure so the mast can slide and pivot, the base of the strut being laterally spaced apart from the main hull.

16. The sailing vessel of claim 15 in which the mast mounting track is generally transverse to the longitudinal axis of the main hull.

17. The sailing vessel of claim 15 in which the strut is pivotally mounted to the mast.

18. The sailing vessel of claim 17 in which the base of the strut is pivotally mounted to a support supported by the connecting arm.

19. The sailing vessel of claim 15 in which the mast mounting track is sufficiently curved that the mast can be supported thereon at an angle less than 15 degrees off the horizon.

20. The sailing vessel of claim 19 in which the mast mounting track is sufficiently curved that the mast can be supported thereon at an angle greater than 5 degrees to leeward.

21. The sailing vessel of claim 15 in which the mast mounting track is sufficiently curved that the mast can be supported thereon at an angle greater than 5 degrees to leeward.

22. The sailing vessel of claim 15 in which one end of the mast mounting track is pivotally mounted and the other end can slide along a curved slide oriented generally parallel to the longitudinal axis of the main hull.

23. The sailing vessel of claim 15 in which the main hull is provided with a pair of rudders, one rudder located near each end of the main hull, the rudders being verticaly slideably mounted through the main hull and having an up position and a down position, the vessel including means biasing each rudder to its up position and control means for pulling either one of the rudders downwardly to its down position so that only one of the rudders is in the water, each rudder being rotatable on its vertical axis when in the down position but not being rotatable on its vertical axis when in the up position.

24. The vessel of claim 23 in which each rudder comprises an upper airfoil portion.

25. The vessel of claim 15 in which the base of the strut is pivotally supported by the hull structure.

26. The vessel of claim 15 in which the mast mounting track is curved.

* * * * *